US010984733B2

(12) United States Patent
Wu et al.

(10) Patent No.: US 10,984,733 B2
(45) **Date of Patent: *Apr. 20, 2021**

(54) CIRCUIT ARRANGEMENT FOR CONTROLLING BACKLIGHT SOURCE AND OPERATION METHOD THEREOF

(71) Applicant: Novatek Microelectronics Corp., Hsinchu (TW)

(72) Inventors: Chung-Wen Wu, Yilan County (TW); Wen-Chi Lin, Yilan County (TW); Jiun-Yi Lin, Taichung (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/854,920

(22) Filed: Apr. 22, 2020

(65) Prior Publication Data

US 2020/0251058 A1 Aug. 6, 2020

Related U.S. Application Data

(63) Continuation of application No. 16/163,593, filed on Oct. 18, 2018, now Pat. No. 10,665,177, which is a (Continued)

(51) Int. Cl.
*G09G 3/34* (2006.01)
*G09G 3/36* (2006.01)

(52) U.S. Cl.
CPC ..... *G09G 3/3406* (2013.01); *G09G 3/36* (2013.01); *G09G 2310/06* (2013.01); (Continued)

(58) Field of Classification Search
CPC ..... G09G 3/3406; G09G 2310/0264; G09G 2310/08; G09G 2310/06; (Continued)

(56) References Cited

U.S. PATENT DOCUMENTS 8,907,735 B2 12/2014 Chin et al.
9,159,287 B2 10/2015 Sakashita
(Continued)

FOREIGN PATENT DOCUMENTS

CN 102804255 11/2012
CN 103427808 12/2013
(Continued)

OTHER PUBLICATIONS

"Office Action of China Counterpart Application", dated Sep. 28, 2020, pp. 1-11.
(Continued)

*Primary Examiner* — Antonio Xavier
(74) *Attorney, Agent, or Firm* — JCIPRNET

(57) ABSTRACT

A circuit arrangement for controlling a backlight source and an operation method are provided. The circuit arrangement includes a generator. The generator receives a sync signal and generates a pulse width modulation signal synchronous with the sync signal to control the backlight source. The sync signal indicates a frequency of a video including a series of image frames. The sync signal includes a sync period corresponding to a frame of the video. The pulse width modulation signal includes a first waveform pattern in a first sub-period of the sync period and a second waveform pattern in a second sub-period of the sync period. Each of the first waveform pattern and the second waveform pattern includes at least one active pulse. The first waveform pattern is substantially identical to the second waveform pattern.

52 Claims, 14 Drawing Sheets

Related U.S. Application Data continuation-in-part of application No. 15/828,396, filed on Nov. 30, 2017, now Pat. No. 10,692,443.

(52) U.S. Cl.
CPC ..... *G09G 2320/0247* (2013.01); *G09G 2320/064* (2013.01); *G09G 2320/0646* (2013.01); *G09G 2320/10* (2013.01)

(58) Field of Classification Search
CPC ..... G09G 2320/0247; G09G 2320/064; G09G 2320/0646; G09G 2320/10; G02F 1/133602; H03K 7/08
See application file for complete search history.

(56) References Cited

U.S. PATENT DOCUMENTS

| | | | |
|---|---|---|---|
| 10,692,443 | B2 | 6/2020 | Wu et al. |
| 2007/0211014 | A1 | 9/2007 | Kim et al. |
| 2010/0277214 | A1 | 11/2010 | Chang et al. |
| 2011/0074301 | A1 | 3/2011 | Goder |
| 2012/0306945 | A1 | 12/2012 | Lee et al. |
| 2012/0313985 | A1 | 12/2012 | Gotoh |
| 2013/0307634 | A1 | 11/2013 | Chin et al. |
| 2013/0321365 | A1 | 12/2013 | Chang |
| 2013/0342434 | A1 | 12/2013 | Chen et al. |
| 2016/0098962 | A1 | 4/2016 | Shibazaki |
| 2019/0164506 | A1 | 5/2019 | Wu et al. |

FOREIGN PATENT DOCUMENTS

| | | |
|---|---|---|
| CN | 103594062 | 2/2014 |
| CN | 103650023 | 3/2014 |
| CN | 105489174 | 4/2016 |
| CN | 109859696 | 6/2019 |
| TW | 1380257 | 12/2012 |
| TW | 201401252 | 1/2014 |

OTHER PUBLICATIONS

"Office Action of China Counterpart Application", dated Dec. 24, 2020, pp. 1-9.

CIRCUIT ARRANGEMENT FOR CONTROLLING BACKLIGHT SOURCE AND OPERATION METHOD THEREOF

CROSS-REFERENCE TO RELATED APPLICATION

This application is a continuation application of and claims the priority benefit of a prior application Ser. No. 16/163,593, filed on Oct. 18, 2018, which is a continuation-in-part application of and claims the priority benefit of a prior application Ser. No. 15/828,396, filed on Nov. 30, 2017, now pending. The entirety of the above-mentioned patent application is hereby incorporated by reference herein and made a part of this specification.

BACKGROUND

Field of the Invention

The invention relates to a display device and more particularly, to a circuit arrangement for controlling a backlight source and an operation method thereof.

Description of Related Art

FIG. 1 is schematic waveform diagram of a backlight control signal BL1 when a backlight device of the related art controls/drives a backlight source in an asynchronous manner. In FIG. 1, the vertical axis represents the voltage, and the horizontal axis represents the time. In FIG. 1, Vsync represents a vertical sync signal, and DE represents a data enablement signal. A video processing circuit (not shown) may transmit the vertical sync signal Vsync and the data enablement signal DE to a panel driving circuit (not shown), so as to control the panel driving circuit to drive a liquid crystal display (LCD) panel (not shown). The vertical sync signal Vsync defines a plurality of video frame periods, for example, video frame periods F1, F2, F3 and F4 illustrated in FIG. 1. As illustrated in FIG. 1, the backlight control signal BL1 of the backlight device of the related art is unrelated to phases (or timings) of the video frame periods F1, F2, F3 and F4, i.e., the backlight device of the related art controls a backlight source (not shown) in an asynchronous manner. An issue of motion blur may occurs to the LCD panel using the asynchronous backlight.

FIG. 2A is schematic waveform diagram of a backlight control signal BL2 when the backlight device of the related art controls/drives the backlight source in a synchronous manner. In FIG. 2A, the vertical axis represents voltages, the horizontal axis represents the time. In FIG. 2A, Vsync represents a vertical sync signal, and DE represents a data enablement signal. The vertical sync signal Vsync defines a plurality of video frame periods, for example, video frame periods F1, F2 and F3 as illustrated in FIG. 2A. As illustrated in FIG. 2A, a phase (or a timing) of the backlight control signal BL2 of the backlight device of the related art may be synchronous with the video frame periods F1, F2, F3 and F4 in accordance with the vertical sync signal Vsync, i.e., the backlight device of the related art controls/drives a backlight source (not shown) in a synchronous manner. When the backlight control signal BL2 is at a high level, the backlight source provides backlight. When the backlight control signal BL2 is at a low level, the backlight source does not provide backlight. Pulse widths PW2 of the backlight control signal BL2 in the video frame periods F1, F2, F3 and F4 are equal to one another, and the pulse widths PW2 may be modulated according to use requirements.

FIG. 2B is a schematic waveform diagram of a backlight control signal BL2 when the backlight device of another related art controls/drives the backlight source in a synchronous manner. In FIG. 2B, the vertical axis represents the voltage, and the horizontal axis represents the time. The vertical sync signal Vsync and the data enablement signal DE illustrated in FIG. 2B may be derived with reference to the description related to FIG. 2A and thus, will not be repeated. As illustrated in FIG. 2B, a phase (or a timing) of the backlight control signal BL2 of the backlight device of the related art may be synchronous with the video frame periods F1, F2, F3 and F4 in accordance with the data enablement signal DE, i.e., the backlight device of the related art controls/drives a backlight source (not shown) in a synchronous manner. Pulse widths PW2 of the backlight control signal BL2 in the video frame periods F1, F2, F3 and F4 are equal to one another, and the pulse widths PW2 may be modulated according to use requirements. In any case, in an actual application environment, a period length of the vertical sync signal Vsync (a period length of the data enablement signal DE) may not be fixed, and lengths of the video frame periods F1, F2 F4 and F4 are different from one another (as illustrated in FIG. 2A and FIG. 2B). For the LCD panel using the synchronous backlight, an issue of backlight flicker may arise to the backlight device of the related art because the period length of the vertical sync signal Vsync is not fixed.

SUMMARY

The invention provides a circuit arrangement for controlling a backlight source and an operation method thereof to improve the issue of backlight flicker.

According to an embodiment of the invention, a circuit arrangement for controlling a backlight source is provided. The circuit arrangement includes a generator. The generator is configured to receive a sync signal and generate a pulse width modulation (PWM) signal synchronous with the sync signal to control the backlight source. The sync signal indicates a frequency of a video including a series of image frames. The sync signal includes a sync period corresponding to a frame of the video. The PWM signal includes a first waveform pattern in a first sub-period of the sync period and a second waveform pattern in a second sub-period of the sync period. Each of the first waveform pattern and the second waveform pattern respectively includes at least one active pulse. The first waveform pattern is substantially identical to the second waveform pattern.

According to an embodiment of the invention, an operation method of a circuit arrangement for controlling a backlight source is provided. The operation method includes: receiving, by a generator, a sync signal indicating a frequency of a video including a series of image frames; and generating, by the generator, a PWM signal synchronous with the sync signal to control the backlight source. The sync signal includes a sync period corresponding to a frame of the video, the PWM signal includes a first waveform pattern in a first sub-period of the sync period and a second waveform pattern in a second sub-period of the sync period, each of the first waveform pattern and the second waveform pattern includes at least one active pulse, and the first waveform pattern is substantially identical to the second waveform pattern.

According to an embodiment of the invention, a circuit arrangement for controlling a backlight source is provided.

The circuit arrangement includes a generator. The generator is configured to receive a sync signal and generate a PWM signal synchronous with the sync signal to control the backlight source. The sync signal indicates a frequency of a video including a series of image frames. The sync signal includes a sync period corresponding to a frame of the video. The PWM signal includes a plurality of repeated waveform patterns in a first sub-period and a second sub-period of the sync period. Each of the repeated waveform patterns includes at least one active pulse.

According to an embodiment of the invention, a circuit arrangement for controlling a backlight source is provided. The circuit arrangement includes a generator. The generator is configured to receive a sync signal and generate a PWM signal synchronous with the sync signal to control the backlight source. The sync signal indicates a frequency of a video including a series of image frames. The sync signal includes a sync period corresponding to a frame of the video. The generator at least divides the sync period into a first sub-period and a second sub-period. The PWM signal includes a first waveform pattern in the first sub-period of the sync period and a second waveform pattern in the second sub-period of the sync period. Each of the first waveform pattern and the second waveform pattern includes at least one active pulse.

According to an embodiment of the invention, a circuit arrangement for controlling a backlight source is provided. The circuit arrangement includes a generator. The generator is configured to receive a sync signal and generate a PWM signal synchronous with the sync signal to control the backlight source. The sync signal indicates a frequency of a video including a series of image frames. The sync signal includes a first sync period corresponding to a first frame of the video and a second sync period corresponding to a second frame of the video. The first sync period is longer in time than the second sync period. The PWM signal includes a first waveform pattern in a first sub-period of the first sync period, a second waveform pattern in a second sub-period of the first sync period, and a third waveform pattern in the second sync period. Each of the first waveform pattern, the second waveform pattern and the third waveform pattern includes at least one active pulse. The first waveform pattern is substantially identical to the second waveform pattern.

To sum up, in the circuit arrangement for controlling the backlight source and the operation method thereof provided by the embodiments of the invention, a sync period is at least divided into a first sub-period and a second sub-period. Each of the first waveform pattern in the first sub-period and the second waveform pattern in the second sub-period respectively includes at least one active pulse. The first waveform pattern is substantially identical to the second waveform pattern. If a length of the sync period is too long, the first waveform pattern and the second waveform pattern may achieve an effect of frequency multiplication to prevent human eyes from perceiving the flicker. Thus, the circuit arrangement and the operation method thereof can achieve improving the issue of backlight flicker.

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
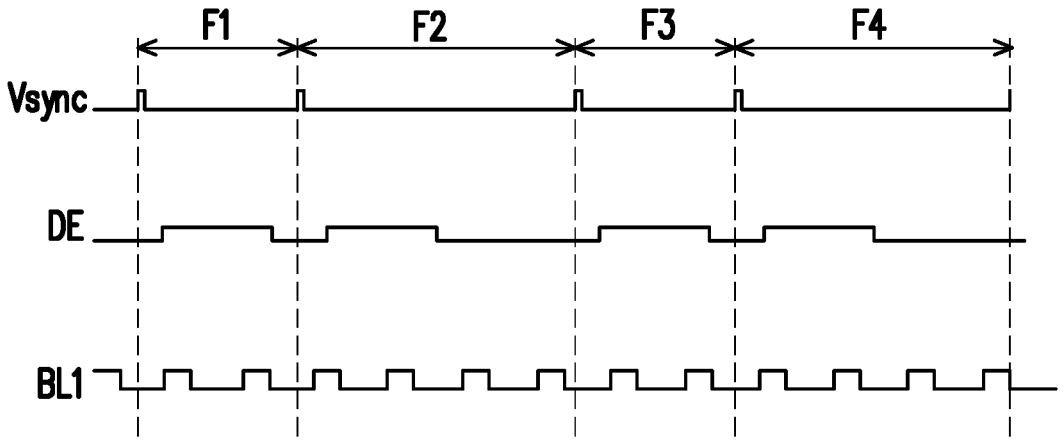
FIG. 1 (RELATED ART)
FIG. 1 is schematic waveform diagram of a backlight control signal when a backlight device of the related art controls/drives a backlight source in an asynchronous manner.
Figure 2A:
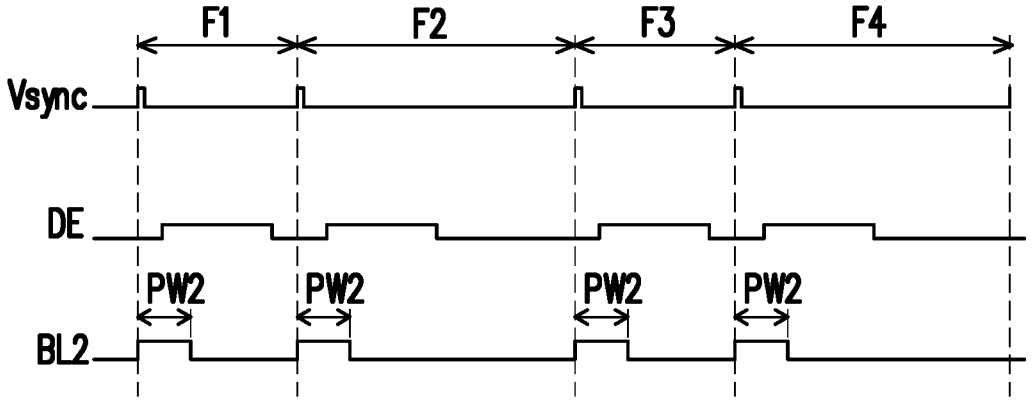
FIG. 2A (RELATED ART)
FIG. 2A is schematic waveform diagram of a backlight control signal when the backlight device of the related art controls/drives the backlight source in a synchronous manner.
Figure 2B:
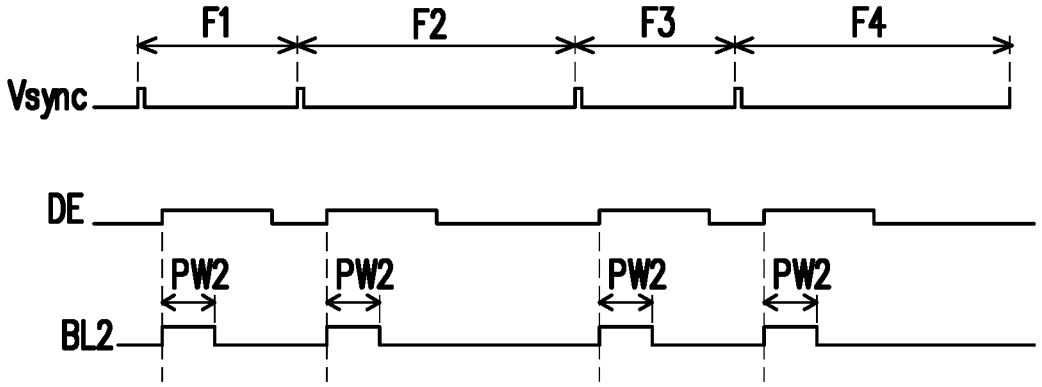
FIG. 2B (RELATED ART)
FIG. 2B is a schematic waveform diagram of a backlight control signal when the backlight device of another related art controls/drives the backlight source in a synchronous manner.

The term "couple (or connect)" herein (including the claims) are used broadly and encompass direct and indirect connection or coupling means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. Moreover, elements/components/steps with same reference numerals represent same or similar parts in the drawings and embodiments. Elements/components/notations with the same reference numerals in different embodiments may be referenced to the related description.

Figure 3:
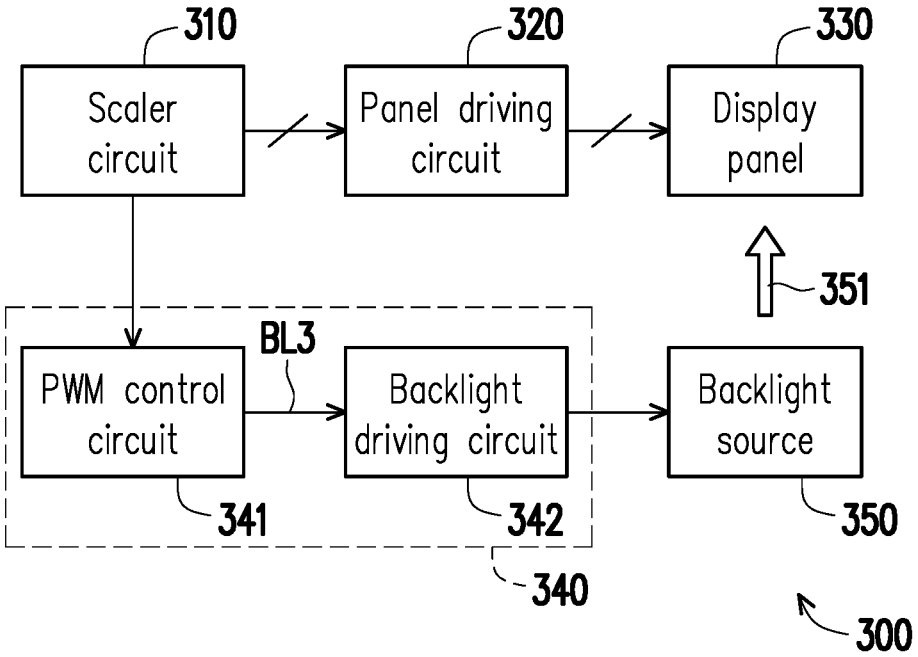
FIG. 3 is a schematic circuit block diagram illustrating a display device according to an embodiment of the invention.

FIG. 3 is a schematic circuit block diagram illustrating a display device 300 according to an embodiment of the invention. The display device 300 includes a display panel 330, a panel driving circuit 320 and a video processing circuit. Based on a design requirement, the video processing circuit is, for example, a scaler circuit 310 and/or other video signal processing circuits. The scaler circuit 310 (the video processing circuit) may transmit a clock signal, a sync signal and video data to the panel driving circuit 320, so as to control the panel driving circuit to drive the display panel 330. Based on a design requirement, the sync signal may include a vertical sync signal, a horizontal sync signal, a data enablement signal and/other sync signals. A plurality of video frame periods may be defined by the video sync signal. In other words, the sync signal may indicate a frequency (or a period) of a video. The video includes a series of image frames. Based on a design requirement, the display panel 330 may be a liquid crystal display (LCD) panel or other types of display panels. The scaler circuit 310, the panel driving circuit 320 and the display panel 330 are conventional components and thus, will not be repeatedly described.

In the embodiment illustrated in FIG. 3, the display device 300 further includes a backlight source 350 and a circuit arrangement for controlling the backlight source 350. In the embodiment illustrated in FIG. 3, the circuit arrangement includes, for example, a generator 340. The generator 340 may receive the sync signal from the video processing circuit (e.g., the scaler circuit 310). According to the sync signal, the generator 340 may control/drive the backlight source 350 in a synchronous manner. The generator 340 may perform global backlight control or local backlight control on the backlight source 350. The backlight source 350 may provide backlight 351 to the display panel 330. Based on a design requirement, the backlight source 350 may be a direct type backlight module or an edge-lighting type backlight module. As the generator 340 controls/drives the backlight source in the synchronous manner, the issue of motion blur may be effectively improved.

In the embodiment illustrated in FIG. 3, the generator 340 includes a pulse width modulation (PWM) control circuit 341 and a backlight driving circuit 342. The PWM control circuit 341 is coupled to the video processing circuit (e.g., the scaler circuit 310) to receive the sync signal (e.g., the vertical sync signal, the data enablement signal and/or any other sync signal). The PWM control circuit 341 may generate a PWM signal BL3. The backlight driving circuit 342 is coupled to the PWM control circuit 341 to receive the PWM signal BL3. According to the PWM signal BL3, the backlight driving circuit 342 may drive the backlight source 350 of the display panel 330. The PWM control circuit 341 may perform the global backlight control or the local backlight control on the backlight source 350.

Figure 4:
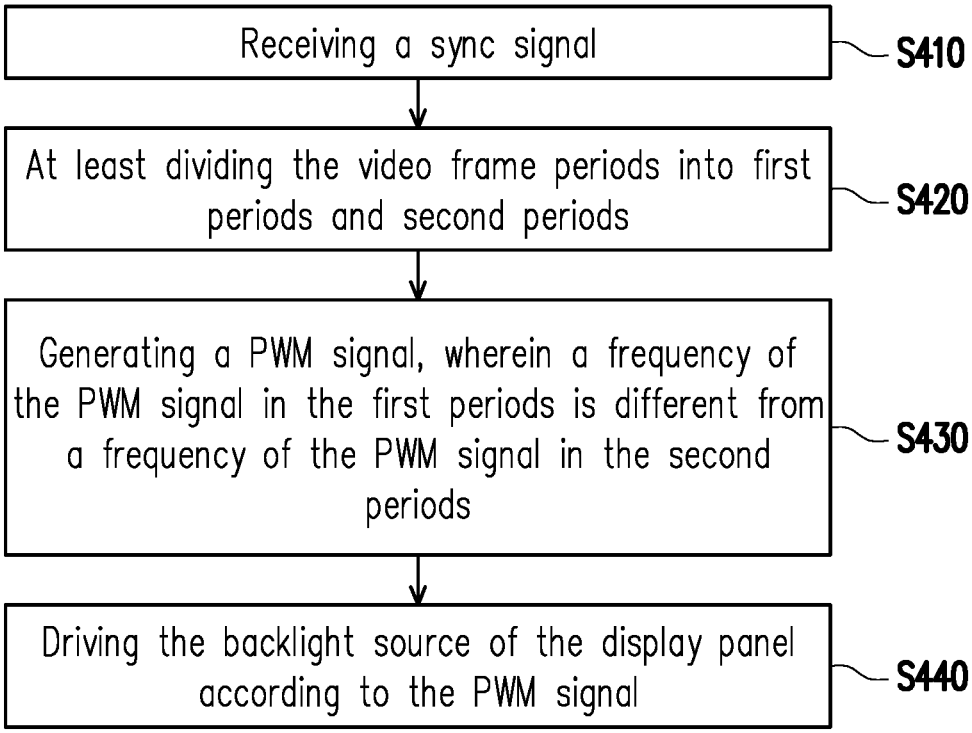
FIG. 4 is a flowchart illustrating an operation method of a circuit arrangement for controlling a backlight source according to an embodiment of the invention.

FIG. 4 is a flowchart illustrating an operation method of a circuit arrangement for controlling a backlight source according to an embodiment of the invention. Referring to FIG. 3 and FIG. 4, in step S410, the PWM control circuit 341 receives the sync signal (e.g., the vertical sync signal, the data enablement signal and/or any other sync signal) from the video processing circuit (e.g., the scaler circuit 310). A plurality of video frame periods are defined by the sync signal. In step S420, the PWM control circuit 341 may at least divide each of the video frame periods into a first period and a second period, wherein lengths of the first periods of different video frame periods are equal to one another.

Figure 5:
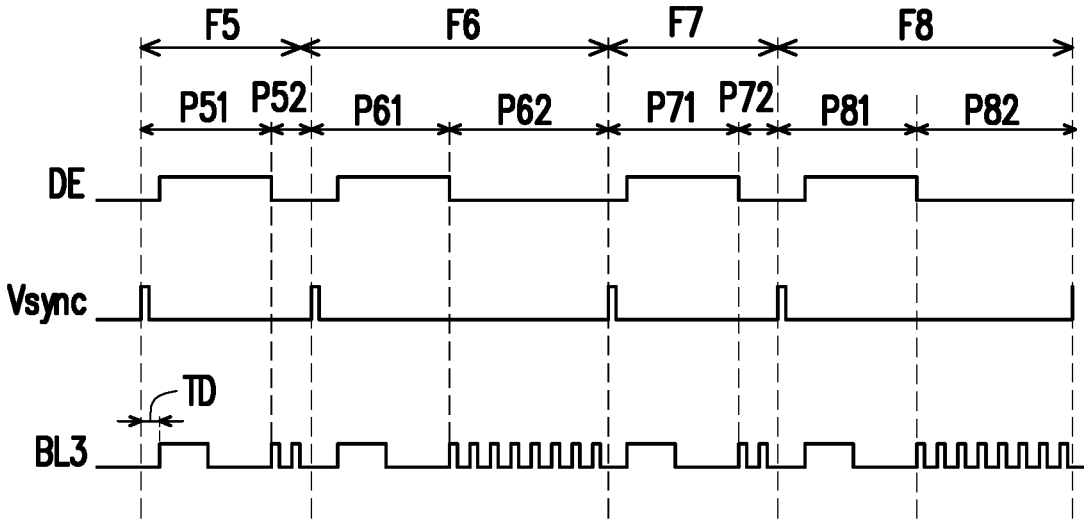
FIG. 5 is a schematic waveform diagram of the pulse width modulation (PWM) signal depicted in FIG. 3 according to an embodiment of the invention.

FIG. 5 is a schematic waveform diagram of the PWM signal BL3 depicted in FIG. 3 according to an embodiment of the invention. In FIG. 5, the vertical axis represents the voltage, and the horizontal axis represents the time. In the implementation example illustrated in FIG. 5, it is assumed that the PWM control circuit 341 receives a vertical sync signal Vsync (i.e., video sync information) from the video processing circuit (e.g., the scaler circuit 310). Referring to FIG. 3, FIG. 4 and FIG. 5, a plurality of video frame periods are defined by the vertical sync signal Vsync (i.e., the video sync information), for example, video frame periods F5, F6, F7 and F8 as illustrated in FIG. 5. In another embodiment, the PWM control circuit 341 may receive the data enablement signal DE (i.e., the sync signal) from the video processing circuit (e.g., the scaler circuit 310), and a plurality of video frame periods may also be defined by the data enablement signal DE, for example, the video frame periods F5, F6, F7 and F8 as illustrated in FIG. 5.

In step S420, the PWM control circuit 341 may at least divide each of the video frame periods into a first period and a second period. Based on a design requirement, a first period includes a part or all of a data period of each of the video frame periods, and a second period includes a part or all of a blanking period of each of the video frame periods.

For instance, according to the data enablement signal DE in the sync signal, the video frame period F5 is at least divided into a first period P51 and a second period P52, the video frame period F6 is at least divided into a first period P61 and a second period P62, the video frame period F7 is at least divided into a first period P71 and a second period P72, and the video frame period F8 is at least divided into a first period P81 and a second period P82. Lengths of the first periods P51, P61, P71 and P81 of the video frame periods F5 to F8 are equal to one another. The first period P51 includes a data period of the video frame period F5, and the second period P52 includes a blank period of the video frame period F5. The first period P61 includes a data period of the video frame period F6, and the second period P62 includes a blank period of the video frame period F6. The first period P71 includes a data period of the video frame period F7, and the second period P72 includes a blank period of the video frame period F7. The first period P81 includes a data period of the video frame period F8, and the second period P82 includes a blank period of the video frame period F8.

In step S430, the PWM control circuit 341 may generate the PWM signal BL3. A frequency of the PWM signal BL3 in the first periods is different from a frequency of the PWM signal BL3 in the second periods, but a duty ratio of the PWM signal BL3 in the first periods is equal to a duty ratio of the PWM signal BL3 in the second periods. For instance, the frequency of the PWM signal BL3 in the first period P51 is different from the frequency of the PWM signal BL3 in the second period P52, but the duty ratio of the PWM signal BL3 in each duty cycle of the first period P51 is equal to the duty ratio of the PWM signal BL3 in each duty cycle of the second period P52.

In the embodiment illustrated in FIG. 5, the frequency of the PWM signal BL3 in the first periods is less than the frequency of the PWM signal BL3 in the second periods. For instance, the frequency of the PWM signal BL3 in the first period P51 is less than the frequency of the PWM signal BL3 in the second period P52.

The backlight driving circuit 342 is coupled to the PWM control circuit 341 to receive the PWM signal BL3. In step S440, the backlight driving circuit 342 drives the backlight source 350 of the display panel 330 according to the PWM signal BL3, thereby driving the backlight source 350 to provide the backlight 351 to the display panel 330.

Based on the above, by the generator 340 and the operation method thereof provided by the present embodiment, each video frame period is at least divided into the first period and the second period. The lengths of the first periods of different video frame periods are equal to one another. If the length of each video frame period is changed, the lengths of the second periods are changed along therewith, but the lengths of the first periods are not. The frequency of the PWM signal BL3 in the first periods is different from the frequency of the PWM signal BL3 in the second periods, but the duty ratio of the PWM signal BL3 in each first period is equal to the duty ratio of the PWM signal BL3 in each second period. Thus, with the backlight source 350 being driven/controlled to provide compensation light (i.e., the backlight 351) in the second periods, the average backlight brightness in different video frame periods F5 to F8 may tend to be approximately equal to one another. In other words, the generator 340 and the operation method thereof may achieve improving the issue of backlight flicker.

Figure 6:
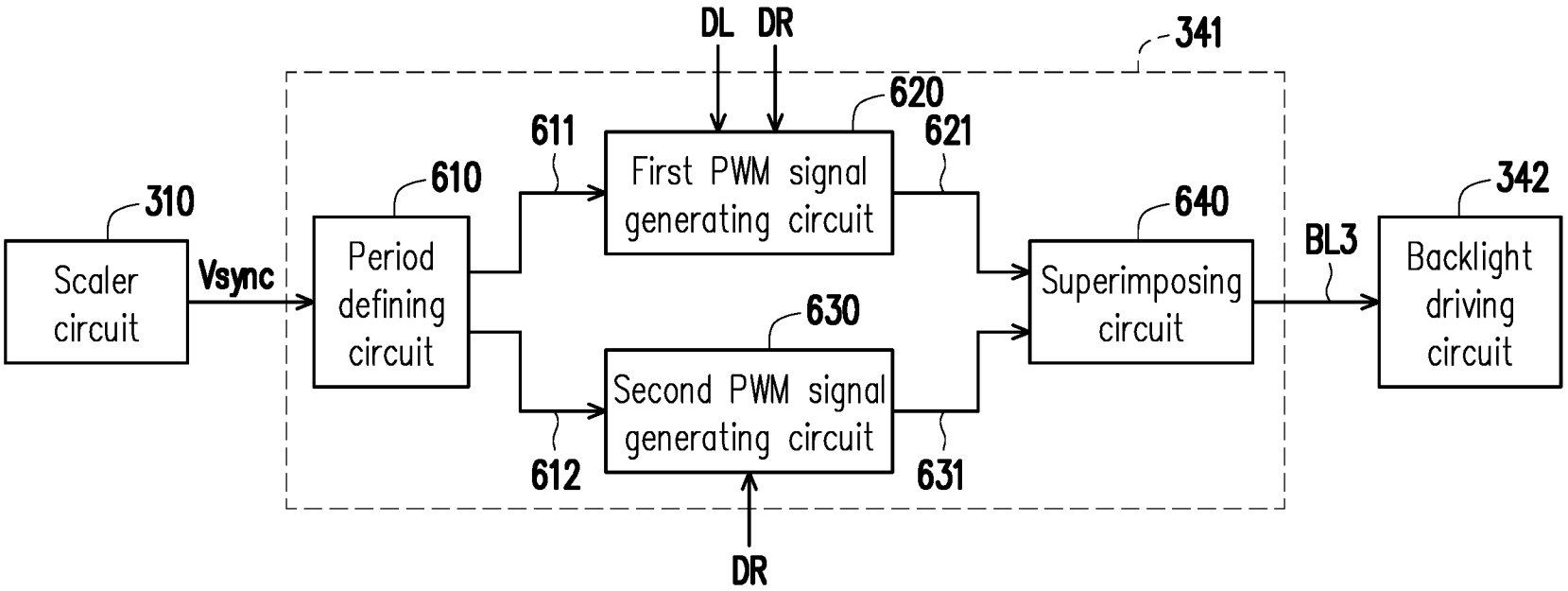
FIG. 6 is a schematic circuit block diagram illustrating the PWM control circuit depicted in FIG. 3 according to an embodiment of the invention.

FIG. 6 is a schematic circuit block diagram illustrating the PWM control circuit 341 depicted in FIG. 3 according to an embodiment of the invention. In the embodiment illustrated in FIG. 6, the PWM control circuit 341 includes a period defining circuit 610, a first PWM signal generating circuit 620, a second PWM signal generating circuit 630 and a superimposing circuit 640. The period defining circuit 610 is coupled to the video processing circuit (e.g., the scaler circuit 310) to receive the sync signal (e.g., the vertical sync signal Vsync) from the video processing circuit. According to a timing of the vertical sync signal Vsync, the period defining circuit 610 may generate a first enablement signal 611 and a second enablement signal 612. The first periods may be defined by the first enablement signal 611, and the second periods may be defined by the second enablement signal 612.

Figure 7:
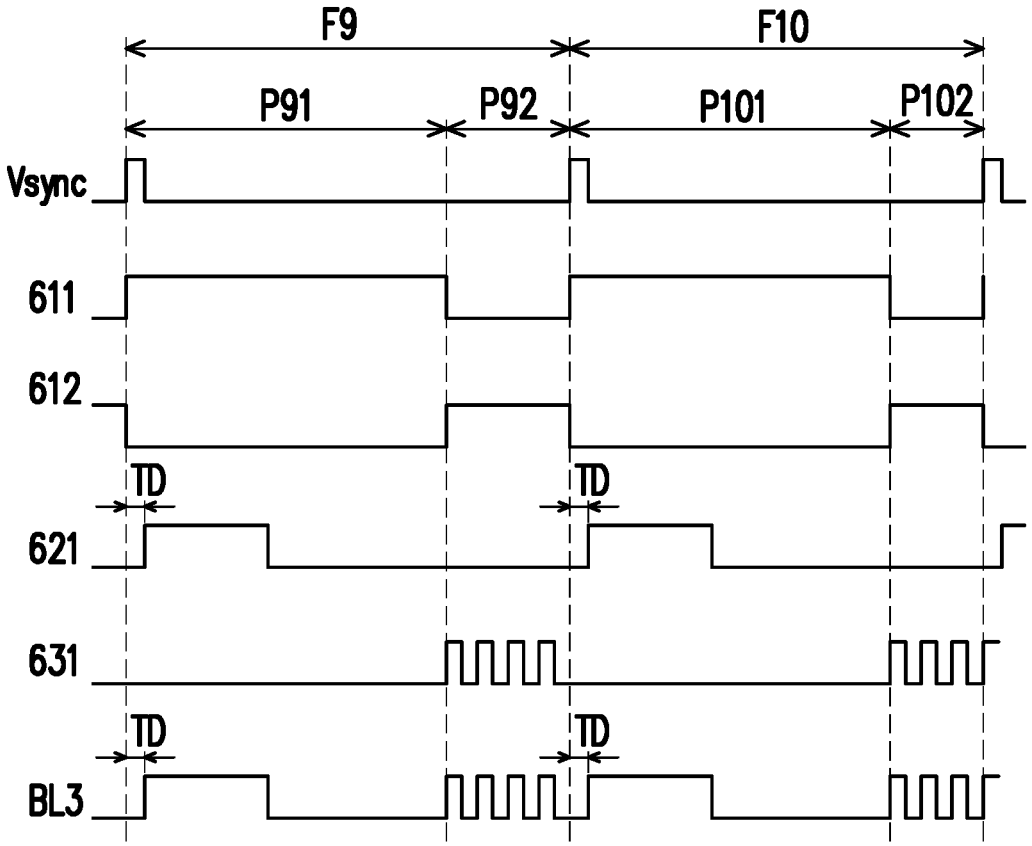
FIG. 7 is a schematic waveform diagram of the signals depicted in FIG. 6 according to an embodiment of the invention.

For instance, FIG. 7 is a schematic waveform diagram of the signals depicted in FIG. 6 according to an embodiment of the invention. In FIG. 7, the vertical axis represents the voltage, and the horizontal axis represents the time. A plurality of video frame periods are defined by the vertical sync signal Vsyn, for example, video frame periods F9 and F10 as illustrated in FIG. 7. The video frame period F9 is at least divided into a first period P91 and a second period P92, and the video frame period F10 is at least divided into a first period P101 and a second period P102. The first periods P91 and P101 may be defined by the first enablement signal 611, and the second periods P92 and P102 may be defined by the second enablement signal 612. Lengths of the first periods P91 and P101 are equal to each other. If the length of each video frame period is changed, the lengths of the second periods P92 and P102 are changed along therewith, but the lengths of the first periods P91 and P101 are not.

Referring to FIG. 6 and FIG. 7, the first PWM signal generating circuit 620 is coupled to the period defining circuit 610 to receive the first enablement signal 611. The first PWM signal generating circuit 620 may generate the first PWM signal 621 in each first period according to the first enablement signal 611. The first PWM signal generating circuit 620 may determine a duty ratio of the first PWM signal 621 in the first period according to a duty ratio parameter DR. It is assumed that the duty ratio is 50% in the embodiment illustrated in FIG. 7, while the duty ratio may be adjusted based on use requirements in other embodiments. The first PWM signal generating circuit 620 may further determine a phase of the first PWM signal 621 in each first period according to a delay parameter DL. The first PWM signal generating circuit 620 may be any type of PWM signal generating circuit/element. For example, the first PWM signal generating circuit 620 may be a PWM signal generating circuit that is well known in this field or any other PWM signal generating circuit.

In the embodiment illustrated in FIG. 7, when the first enablement signal 611 is at a low level, the first PWM signal generating circuit 620 is disabled. When the first enablement signal 611 is at a high level, the first PWM signal generating circuit 620 is enabled. Thus, the first PWM signal generating circuit 620 may generate the first PWM signal 621 in the first periods P91 and P101. The first PWM signal generating circuit 620 may set the duty ratio of the first PWM signal 621 in the first periods P91 and P101 to 50% according to the duty ratio parameter DR. The first PWM signal generating circuit 620 may further determine a time of delay TD of a pulse of the first PWM signal 621 in the first periods P91 and P101 according to the delay parameter DL, i.e., determine a phase of the first PWM signal 621 in the first periods P91 and P101.

The second PWM signal generating circuit 630 is coupled to the period defining circuit 610 to receive the second enablement signal 612. The second PWM signal generating circuit 630 may generate the second PWM signal 631 according to the second enablement signal 612 in the second periods. The second PWM signal generating circuit 630 may determine a duty ratio of the second PWM signal 631 in the second periods according to the duty ratio parameter DR. In the embodiment illustrated in FIG. 7, when the second enablement signal 612 is at a low level, the second PWM signal generating circuit 630 is disabled. When the second enablement signal 612 is at a high level, the second PWM signal generating circuit 630 is enabled. Thus, the second PWM signal generating circuit 630 may generate the second PWM signal 631 in the second periods P92 and P102. The second PWM signal generating circuit 630 may set the duty ratio of the second PWM signal 631 in the second periods P92 and P102 to 50% according to the duty ratio parameter DR. A frequency of the second PWM signal 631 in the second periods P92 and P102 is different from a frequency of the first PWM signal 621 in the first periods P91 and P101. The second PWM signal generating circuit 630 may be any type of PWM signal generating circuit/element. For example, the second PWM signal generating circuit 630 may be a PWM signal generating circuit that is well known in this field or any other PWM signal generating circuit.

The superimposing circuit 640 is coupled to the first PWM signal generating circuit 620 to receive the first PWM signal 621. The superimposing circuit 640 is coupled to the second PWM signal generating circuit 630 to receive the second PWM signal 631. The superimposing circuit 640 may superimpose the first PWM signal 621 and the second PWM signal 631 to obtain the PWM signal BL3, as illustrated in FIG. 7.

Figure 8:
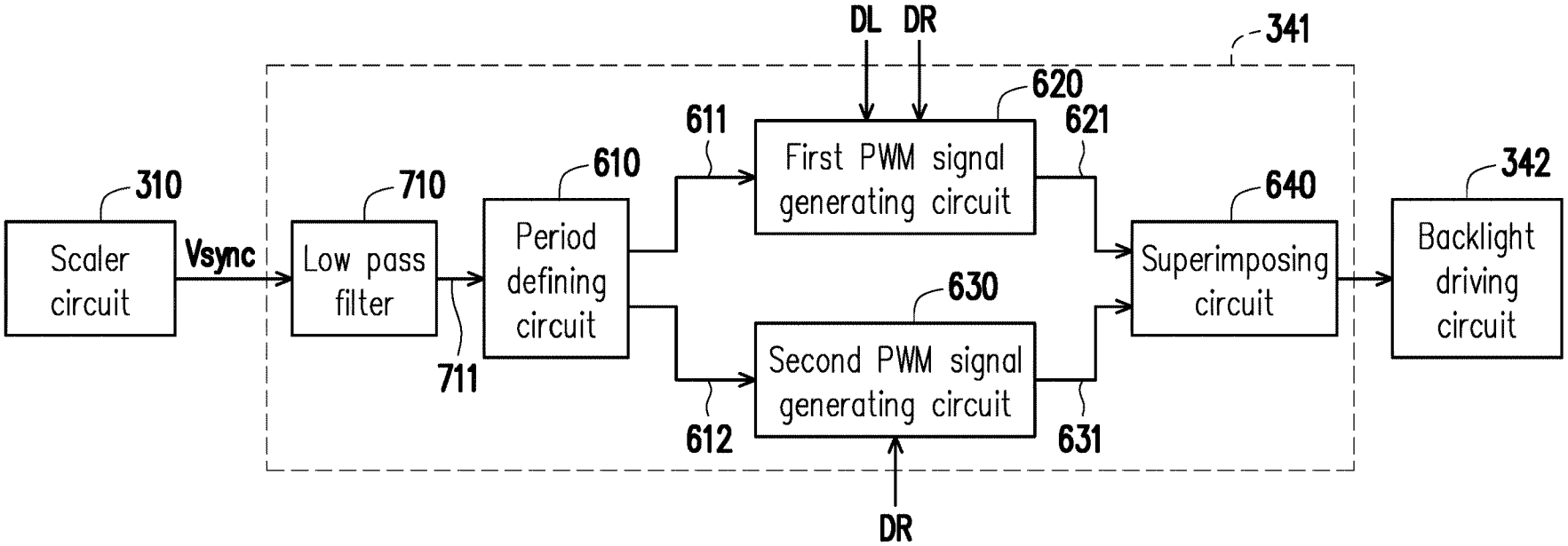
FIG. 8 is a schematic circuit block diagram illustrating the PWM control circuit depicted in FIG. 3 according to another embodiment of the invention.

FIG. 8 is a schematic circuit block diagram illustrating the PWM control circuit 341 depicted in FIG. 3 according to another embodiment of the invention. In the embodiment illustrated in FIG. 8, the PWM control circuit 341 includes a low pass filter 710, a period defining circuit 610, a first PWM signal generating circuit 620, a second PWM signal generating circuit 630 and a superimposing circuit 640. The period defining circuit 610, the first PWM signal generating circuit 620, the second PWM signal generating circuit 630 and the superimposing circuit 640 illustrated in FIG. 8 may be inferred with reference to the descriptions related to the embodiments illustrated in FIG. 6 and FIG. 7 and thus, will not be repeated.

Figure 9:
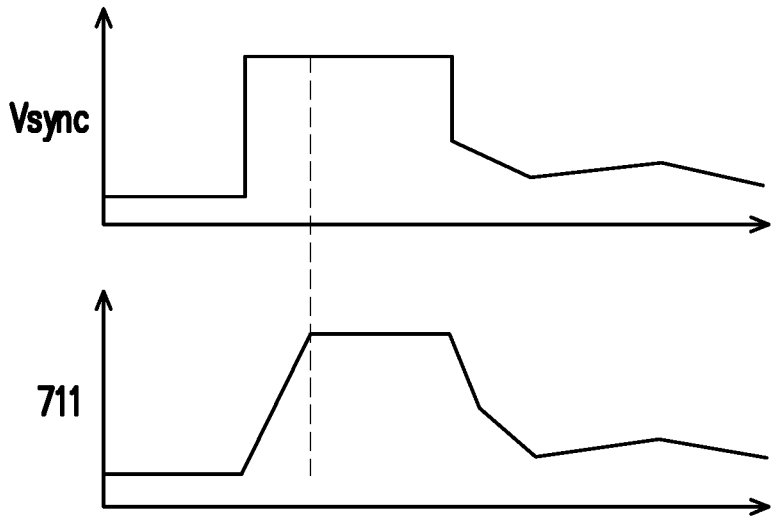
FIG. 9 is a schematic waveform diagram illustrating the vertical sync signal and the smoothed signal depicted in FIG. 8 according to an embodiment of the invention.

In the embodiment illustrated in FIG. 8, the low pass filter 710 is coupled to the video processing circuit (e.g., the scaler circuit 310) to receive the sync signal (e.g., the vertical sync signal Vsync) from the video processing circuit. The low pass filter 710 may output a smoothed signal 711 to the period defining circuit 610. FIG. 9 is a schematic waveform diagram of the vertical sync signal Vsync and the smoothed signal 711 depicted in FIG. 8 according to an embodiment of the invention. As illustrated in FIG. 9, the low pass filter 710 may smooth the vertical sync signal Vsync to generate the smoothed signal 711. The period defining circuit 610 is coupled to the low pass filter 710 to receive the smoothed signal 711. The period defining circuit 610 may generate the first enablement signal 611 and the second enablement signal 612 according to a timing of the smoothed signal 711.

In the embodiments described above, the backlight source 350 is controlled/driven by the generator 340 and the operation method thereof in a synchronous manner, and thus, the issue of motion blur may be effectively improved. The generator 340 and the operation method thereof may be applied to the backlight control of variable vertical sync signals or fixed vertical sync signals. By the generator 340 and the operation method thereof, each video frame period may be at least divided into the first period and the second period. The lengths of the first periods of different video frame periods are equal to one another. If the length of each video frame period is changed, the lengths of the second periods are changed along therewith, but the lengths of the first periods are not. The frequency of the PWM signal BL3 in the first periods is different from the frequency of the PWM signal BL3 in the second periods, but the duty ratio of the PWM signal BL3 in each first period is equal to the duty ratio of the PWM signal BL3 in each second period. Thus, with the backlight source 350 being driven/controlled to provide compensation light (i.e., the backlight 351) in the second periods, the average backlight brightness in different video frame periods may tend to be approximately equal to one another. In other words, the generator 340 and the operation method thereof may achieve improving the issue of backlight flicker.

Figure 10:
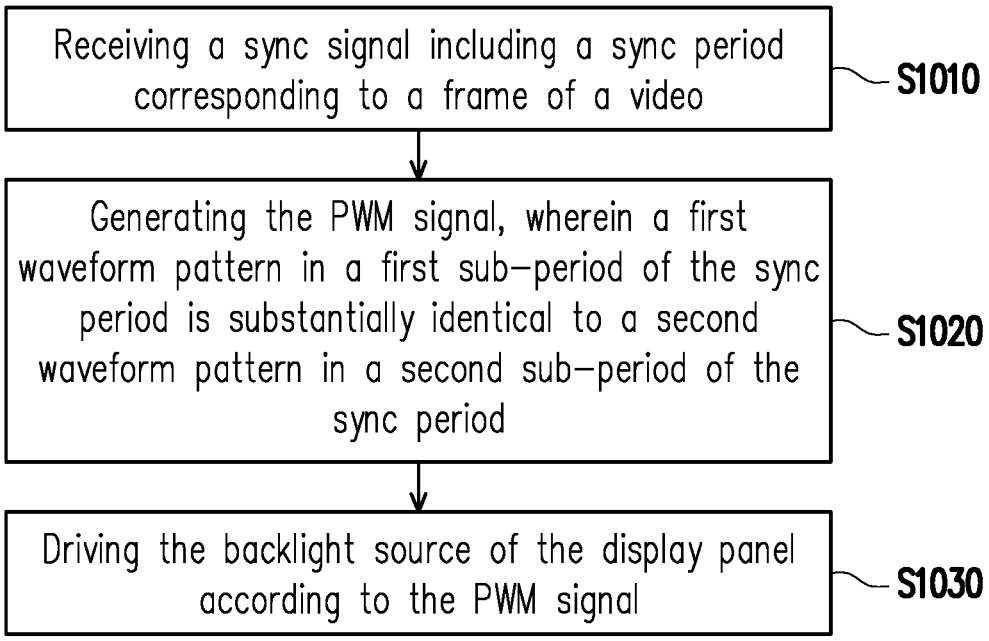
FIG. 10 is a flowchart illustrating an operation method of a circuit arrangement for controlling a backlight source according to another embodiment of the invention.

FIG. 10 is a flowchart illustrating an operation method of a circuit arrangement for controlling a backlight source according to another embodiment of the invention. Referring to FIG. 3 and FIG. 10, in step S1010, the generator 340 receives the sync signal (which includes the vertical sync signal Vsync, the data enablement signal DE and/or other sync signals). The sync signal indicates a frequency of a video including a series of image frames. The sync signal includes a sync period corresponding to a frame of the video.

In step S1020, the generator 340 may generate the PWM signal BL3 synchronous with the sync signal to control the backlight source 350. The generator 340 may at least divide the sync period into a first sub-period and a second sub-period. The PWM signal BL3 includes a first waveform pattern in a first sub-period of the sync period and a second waveform pattern in a second sub-period of the sync period. Each of the first waveform pattern and the second waveform pattern includes at least one active pulse. The first waveform pattern is substantially identical to the second waveform pattern.

In another present embodiment, the PWM signal BL3 includes a plurality of repeated waveform patterns in the first sub-period and the second sub-period of the sync period. Each of the repeated waveform patterns includes at least one active pulse.

In yet another embodiment, the sync signal includes a first sync period corresponding to a first frame of the video and a second sync period corresponding to a second frame of the video. The first sync period is longer in time than the second sync period. The PWM signal includes the first waveform pattern in the first sub-period of the first sync period, the second waveform pattern in the second sub-period of the first sync period, and a third waveform pattern in the second sync period. Each of the first waveform pattern, the second waveform pattern and the third waveform pattern includes at least one active pulse. The first waveform pattern is substantially identical to the second waveform pattern.

In step S1030, the generator 340 may drive the backlight source 350 of the display panel 330 according to the PWM signal BL3, thereby driving the backlight source 350 to provide the backlight 351 to the display panel 330. Step S1030 illustrated in FIG. 10 may refer to the description related to step S440 illustrated in FIG. 4 and thus, will not be repeated.

In the present embodiment, the PWM control circuit 341 of the generator 340 may receive the sync signal from the scaler circuit 340 (i.e., the video processing circuit). The PWM control circuit 341 may check the frequency (or the period) of the sync signal. When the frequency of the sync signal is lower than a threshold frequency (or when the period of the sync signal is greater than a threshold period), the PWM control circuit 341 multiplies the frequency of the sync signal to generate a multiplied sync signal. The threshold frequency may be determined based on a design requirement. When the frequency of the sync signal is higher than the threshold frequency, the PWM control circuit 341 serves the sync signal as the multiplied sync signal. The PWM control circuit 341 may generate the PWM signal BL3 according to the multiplied sync signal. The backlight driving circuit 342 is coupled to the PWM control circuit 341 to receive the PWM signal BL3. The backlight driving circuit 342 may drive the backlight source 350 of the display panel 330 according to the PWM signal BL3.

The PWM modulation control circuit 341 may check a time length of the sync period. When the time length of the sync period exceeds a rated time length, the PWM control circuit 341 may at least divide the sync period into the first sub-period and the second sub-period. The rated time length may be determined based on a design requirement. A duty ratio of the PWM signal BL3 in the first sub-period is equal to a duty ratio of the PWM signal BL3 in the second sub-period. The frequency of the PWM signal BL3 in the first sub-period is equal to the frequency of the PWM signal BL3 in the second sub-period.

Figure 11:
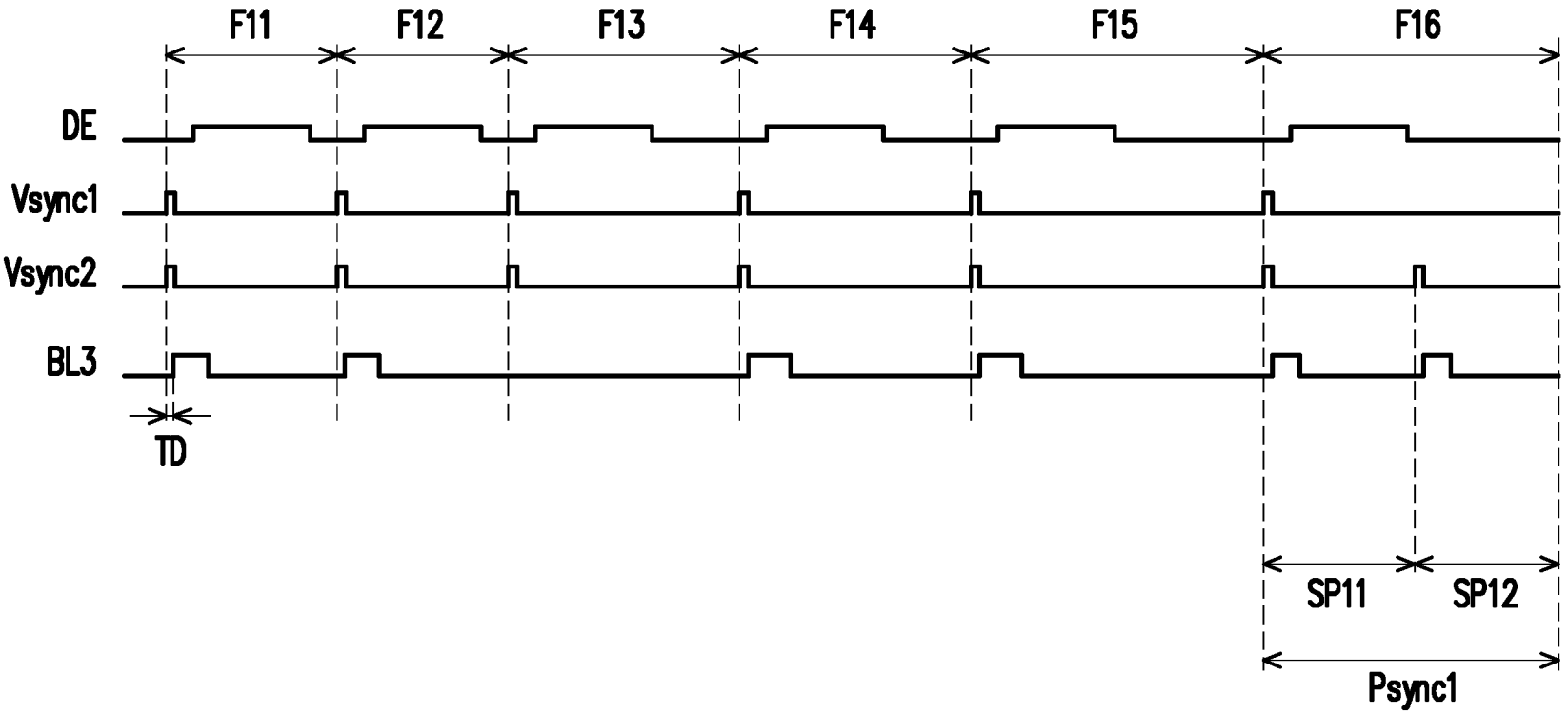
FIG. 11 is a schematic waveform diagram of the PWM signal in FIG. 3 according to yet another embodiment of the invention.

FIG. 11 is a schematic waveform diagram of the PWM signal BL3 depicted in FIG. 3 according to yet another embodiment of the invention. In FIG. 11, the vertical axis represents the voltage, and the horizontal axis represents the time. Referring to FIG. 3, FIG. 10 and FIG. 11, in step S1010, the PWM control circuit 341 receives a sync signal (e.g., a vertical sync signal Vsync1, a data enablement signal DE and/or any other sync signal) from the video processing circuit (e.g., the scaler circuit 310). The vertical sync signal Vsync1 may indicate a frequency (or a period) of a video including a series of image frames, for example, video frames F11, F12, F13, F14, F15 and F16 illustrated in FIG. 11. The sync signal includes a sync period corresponding to a frame of the video. For example, the video frame F16 corresponds to a sync period Psync1.

The PWM control circuit 341 may check a time length of the sync period (for example, the sync period Psync1 illustrated in FIG. 11). In this case, the sync period Psync1 corresponding to the video frame F16 is employed as an example for description. Sync periods corresponding to the rest of the video frames (for example, the video frames F11, F12, F13, F14 and F15) may be inferred with reference to the description related to the sync period Psync1 and thus, will not be repeated. If the sync period Psync1 is too long (i.e., the frequency of the PWM signal BL3 may be too low), human eyes may probably perceive the flicker of the backlight source 350. Thus, when the time length of the sync period Psync1 exceeds the rated time length, the PWM control circuit 341 may at least divide the sync period into a first sub-period SP11 and a second sub-period SP12.

In step S1020, the PWM control circuit 341 may generate the PWM signal BL3 synchronous with the sync signal (for example, the vertical sync signal Vsync1 or the data enablement signal DE) to control the backlight source 350. A duty ratio of the PWM signal BL3 in the first period SP11 is equal to a duty ratio of the PWM signal BL3 in the second period SP12, and a frequency of the PWM signal BL3 in the first period SP11 is equal to a frequency of the PWM signal BL3 in the second period SP12. In step S1030, the backlight driving circuit 342 drives the backlight source 350 of the display panel 330 according to the PWM signal BL3, thereby driving the backlight source 350 to provide the backlight 351 to the display panel 330.

When the time length of the sync period Psync1 exceeds the rated time length, the PWM control circuit 341 may apply the frequency multiplication operation on the PWM signal BL3 in the sync period Psync1, thereby preventing the human eyes from perceiving the flicker of the backlight source 350. Thus, the generator 340 and the operation method thereof may achieve improving the issue of backlight flicker.

Figure 12:
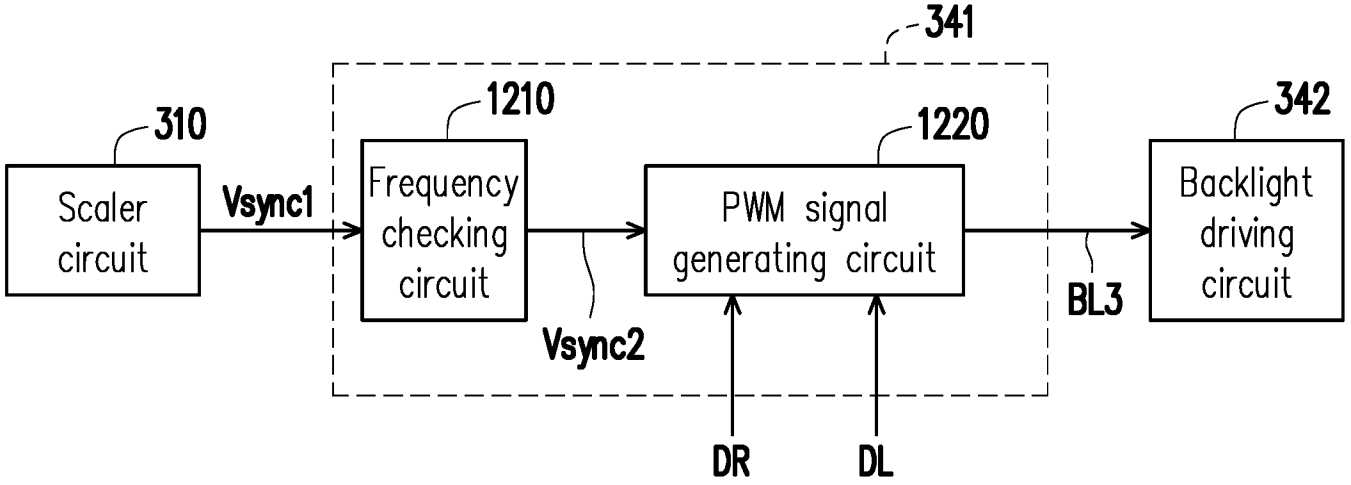
FIG. 12 is a schematic circuit block diagram illustrating the PWM control circuit depicted in FIG. 3 according to yet another embodiment of the invention.

FIG. 12 is a schematic circuit block diagram illustrating the PWM control circuit 341 depicted in FIG. 3 according to yet another embodiment of the invention. In the embodiment illustrated in FIG. 12, the PWM control circuit 341 includes a frequency checking circuit 1210 and a PWM signal generating circuit 1220. The frequency checking circuit 1210 is coupled to the video processing circuit (e.g., the scaler circuit 310) to receive the sync signal (for example, the vertical sync signal Vsync1) from the vertical sync signal. The frequency checking circuit 1210 checks the frequency of the sync signal Vsync1.

Referring to FIG. 11 and FIG. 12, when the frequency of the sync signal Vsync1 is higher than the threshold frequency (or when the period of the sync signal Vsync1 is smaller than the threshold period), the frequency checking circuit 1210 may serve the sync signal Vsync1 as a multiplied sync signal Vsync2. For example, in the video frame F11, a frequency of the multiplied sync signal Vsync2 is equal to the frequency of the vertical sync signal Vsync1. The threshold frequency may be determined based on a design requirement. When the frequency of the sync signal Vsync1 is lower than the threshold frequency (or when the period of the sync signal Vsync1 is greater than the threshold period), the frequency checking circuit 1210 may multiply the frequency of the vertical sync signal Vsync1 to generate the multiplied sync signal Vsync2. Referring to the embodiment illustrated in FIG. 11, in the sync period Psync1, the frequency of the multiplied sync signal Vsync2 may be twice the frequency of the vertical sync signal Vsync1. In any case, the magnification of the frequency multiplication operation may be determined based on a design requirement.

The PWM signal generating circuit 1220 is coupled to the frequency checking circuit 1210 to receive the multiplied sync signal. The PWM signal generating circuit 1220 may generate the PWM signal BL3 to the backlight driving circuit 342 according to the multiplied sync signal Vsync2. The PWM signal generating circuit 1220 may determine the duty ratio of the PWM signal according to the duty ratio parameter DR. The duty ratio parameter DR may be determined based on a design requirement. In addition, the PWM signal generating circuit 1220 may further determine the time of delay TD according to the delay parameter DL, i.e., determine the phase of the PWM signal BL3. The PWM signal generating circuit 1220 may be any type of PWM signal generating circuit/element. For example, the PWM signal generating circuit 1220 may be a PWM signal generating circuit that is well known in this field or any other PWM signal generating circuit.

Figure 13:
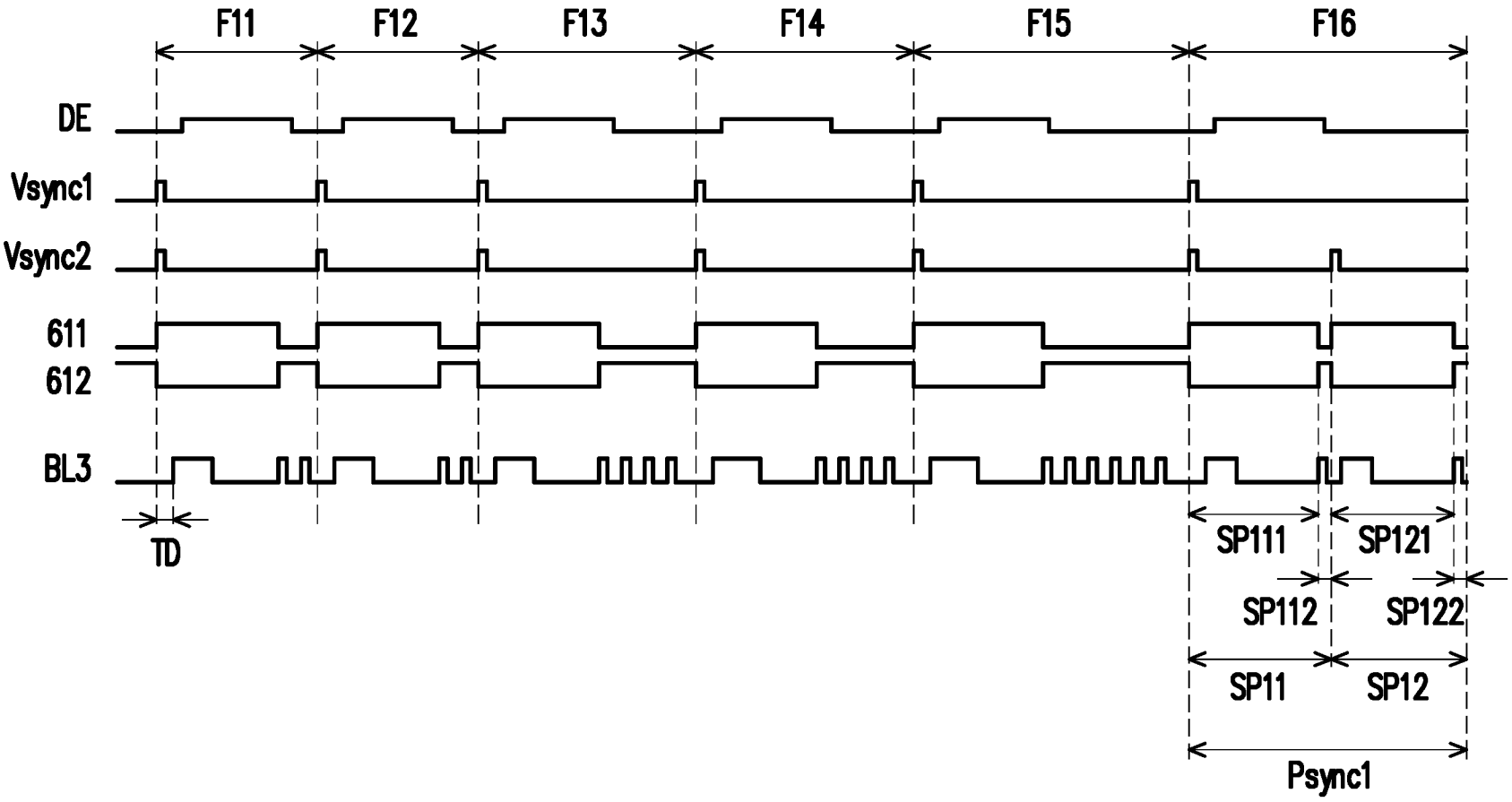
FIG. 13 is a schematic waveform diagram of the PWM signal in FIG. 3 according to still another embodiment of the invention.

FIG. 13 is a schematic waveform diagram of the PWM signal BL3 depicted in FIG. 3 according to still another embodiment of the invention. In FIG. 13, the vertical axis represents the voltage, and the horizontal axis represents the time. In the implementation example illustrated in FIG. 13, it is assumed that the PWM control circuit 341 receives the vertical sync signal Vsync (i.e., video sync information) from the video processing circuit (e.g., the scaler circuit 310). The vertical sync signal Vsync1, the multiplied sync signal Vsync2, the time of delay TD, the video frame F11, the video frame F12, the video frame F13, the video frame F14, the video frame F15, the video frame F16, the sync period Psync1, the first sub-period SP11 and the second sub-period SP12 may refer to the description related to FIG. 11 and thus, will not be repeated.

The PWM control circuit 341 may at least divide the first sub-period SP11 into a third sub-period SP111 and a fourth sub-period SP112 according to the multiplied sync signal Vsync2 and in the same way, may at least divide the second sub-period SP12 into sub-periods SP121 and SP122. Each of the rest of the video frames F11, F12, F13, F14 and F15 illustrated in FIG. 11 may also be divided into a plurality of sub-periods. The sub-periods of the video frames F11, F12, F13, F14 and F15 illustrated in FIG. 11 may refer to the descriptions related to the video frame period F5, the first period P51, the second period P52, the video frame period F6, the first period P61, the second period P62, the video frame period F7, the first period P71, the second period P72, the video frame period F8, the first period P81 and the second period 82 illustrated in FIG. 5 and thus, will not be repeated.

Figure 14:
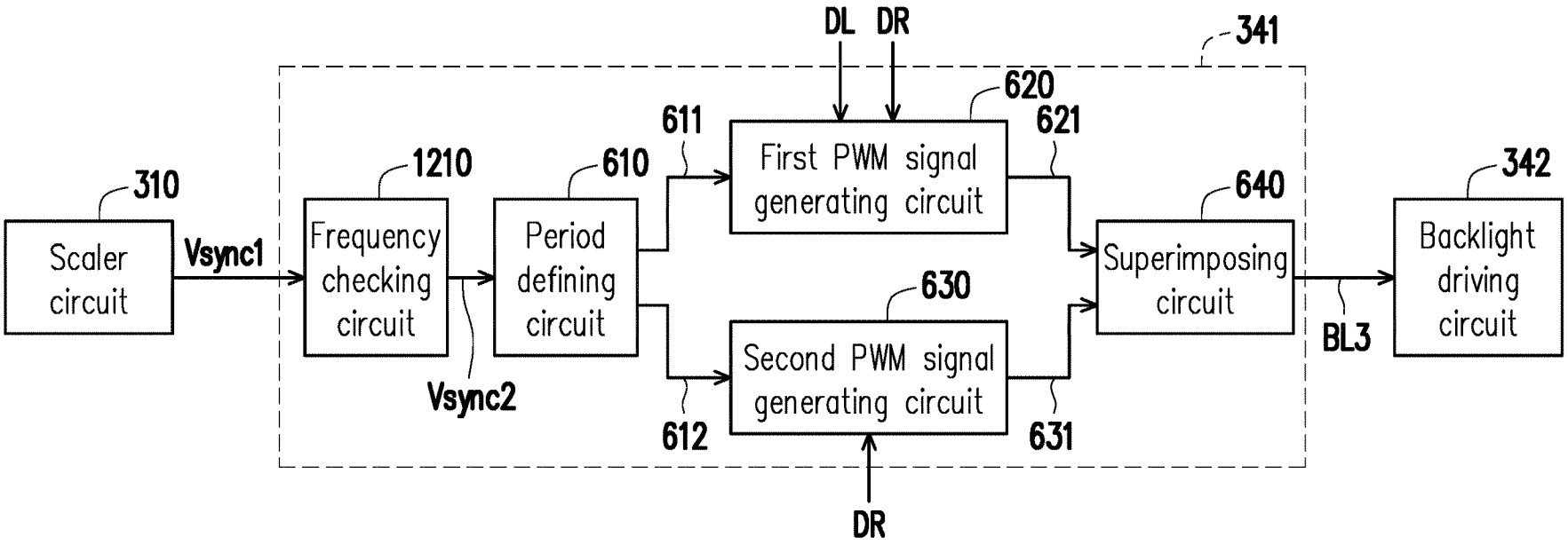
FIG. 14 is a schematic circuit block diagram illustrating the PWM control circuit depicted in FIG. 3 according to still another embodiment of the invention.

FIG. 14 is a schematic circuit block diagram illustrating the PWM control circuit 341 depicted in FIG. 3 according to still another embodiment of the invention. Referring to FIG. 13 and FIG. 14, in the embodiment illustrated in FIG. 14, the PWM control circuit 341 includes a frequency checking circuit 1210, a period defining circuit 610, a first PWM signal generating circuit 620, a second PWM signal generating circuit 630 and a superimposing circuit 640. The frequency checking circuit 1210 is coupled to the video processing circuit (e.g., the scaler circuit 310) to receive the sync signal (for example, the vertical sync signal Vsync1) from the vertical sync signal. The frequency checking circuit 1210 checks the frequency of the vertical sync signal Vsync1 and outputs the multiplied sync signal Vsync2. The frequency checking circuit 1210 and the multiplied sync signal Vsync2 illustrated in FIG. 14 may be inferred with reference to the descriptions related to the frequency checking circuit 1210 and the multiplied sync signal Vsync2 illustrated in FIG. 12 and thus, will not be repeated.

The period defining circuit 610 is coupled to the frequency checking circuit 1210 to receive the multiplied sync signal Vsync2. According to a timing of the vertical sync signal Vsync2, the period defining circuit 610 may generate a first enablement signal 611 and a second enablement signal 612, wherein the third sub-period SP111 and the sub-period SP121 are defined by the first enablement signal 611, and the fourth sub-period SP112 and the sub-period SP122 are defined by the second enablement signal 612. The period defining circuit 610, the first enablement signal 611 and the second enablement signal 612 illustrated in FIG. 14 may be inferred with reference to the descriptions related to the period defining circuit 610, the first enablement signal 611 and the second enablement signal 612 illustrated in FIG. 6 and FIG. 7 and thus, will not be repeated.

The first PWM signal generating circuit 620 is coupled to the period defining circuit 610 to receive the first enablement signal 611. The first PWM signal generating circuit 620 may generate the first PWM signal 621 in the third sub-period SP111 and the sub-period SP121 according to the first enablement signal 611 and determine a duty ratio of the first PWM signal 621 in the third sub-period SP111 and the sub-period SP121 according to the duty ratio parameter DR. The first PWM signal generating circuit 620 may further determine the time of delay TD of a pulse of the first PWM signal 621 in the third sub-period SP111 according to the delay parameter DL, i.e., determine the phase of the first PWM signal 621. The first PWM signal generating circuit 620 and the first PWM signal 621 illustrated in FIG. 14 may be inferred with reference to the descriptions related to the first PWM signal generating circuit 620 and the first PWM signal 621 illustrated in illustrated in FIG. 6 and FIG. 7 and thus, will not be repeated.

The second PWM signal generating circuit 630 is coupled to the period defining circuit 610 to receive the second enablement signal 612. The second PWM signal generating circuit 630 may generate the second PWM signal 631 in the fourth sub-period SP112 and the sub-period SP122 according to the second enablement signal 612 and determine the duty ratio of the second PWM signal 631 in the fourth sub-period SP112 and the sub-period SP122 according to the duty ratio parameter DR. The frequency of the second PWM signal 631 is different from the frequency of the first PWM signal 621. The second PWM signal generating circuit 630 and the second PWM signal 631 illustrated in FIG. 14 may be inferred with reference to the descriptions related to the second PWM signal generating circuit 630 and the second PWM signal 631 illustrated in illustrated in FIG. 6 and FIG. 7 and thus, will not be repeated.

The superimposing circuit 640 is coupled to the first PWM signal generating circuit 620 to receive the first PWM signal 621. The superimposing circuit 640 is coupled to the second PWM signal generating circuit 630 to receive the second PWM signal 631. The superimposing circuit 640 may superimpose the first PWM signal 621 and the second PWM signal 631 to obtain the PWM signal BL3. The superimposing circuit 640 and the PWM signal BL3 illustrated in FIG. 14 may be inferred with reference to the descriptions related to the superimposing circuit 640 and the PWM signal BL3 illustrated in illustrated in FIG. 6 and FIG. 7 and thus, will not be repeated.

Figure 15:
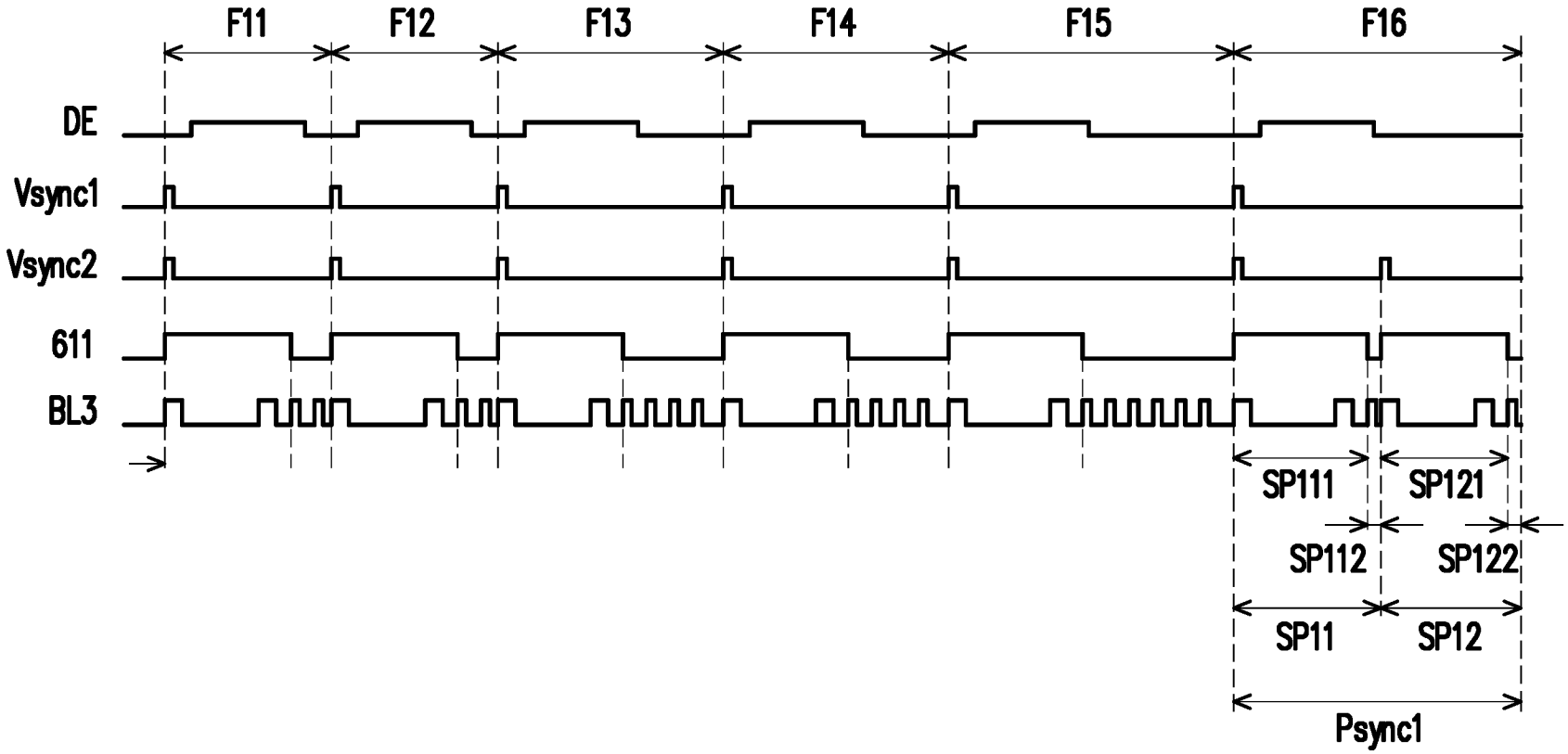
FIG. 15 is a schematic waveform diagram of the PWM signal in FIG. 3 according to further another embodiment of the invention.

FIG. 15 is a schematic waveform diagram of the PWM signal PL3 depicted in FIG. 3 according to further another embodiment of the invention. In FIG. 15, the vertical axis represents the voltage, and the horizontal axis represents the time. In the implementation example illustrated in FIG. 15, it is assumed that the PWM control circuit 341 receives the vertical sync signal Vsync1 (i.e., video sync information) from the video processing circuit (e.g., the scaler circuit 310). The vertical sync signal Vsync1, the multiplied sync signal Vsync2, the video frame F11, the video frame F12, the video frame F13, the video frame F14, the video frame F15, the video frame F16, the sync period Psync1, the first sub-period SP11 and the second sub-period SP12 may refer to the description related to FIG. 11 and/or FIG. 13 and thus, will not be repeated.

In the embodiment illustrated in FIG. 15, the PWM signal BL3 has pulses respectively in an initiate period and an end period in each sub-period, and has no pulse in a middle period in each sub-period. For example, the PWM signal BL3 has pulses respectively in the initiate period and the end period in the third sub-period SP111 without any pulse in a middle period in the third sub-period SP111, as illustrated in FIG. 15. The rest of the sub-periods (for example, the sub-period SP121) may be inferred with reference to the description related to the third sub-period SP111 and thus, will not be repeated.

Based on different design demands, the blocks of the generator 340, the PWM control circuit 341, the backlight driving circuit 342, the frequency checking circuit 1210, the PWM signal generating circuit 1220, the period defining circuit 610, the first PWM signal generating circuit 620, the second PWM signal generating circuit 630 and/or the superimposing circuit 640 may be implemented in a form of hardware, firmware, software (i.e., programs) or in a combination of many of the aforementioned three forms.

In terms of the hardware form, the blocks of the generator 340, the PWM control circuit 341, the backlight driving circuit 342, the frequency checking circuit 1210, the PWM signal generating circuit 1220, the period defining circuit 610, the first PWM signal generating circuit 620, the second PWM signal generating circuit 630 and/or the superimposing circuit 640 may be implemented in logical circuits on an integrated circuit. Related functions of the generator 340, the PWM control circuit 341, the backlight driving circuit 342, the frequency checking circuit 1210, the PWM signal generating circuit 1220, the period defining circuit 610, the first PWM signal generating circuit 620, the second PWM signal generating circuit 630 and/or the superimposing circuit 640 may be implemented in the hardware form by using hardware description languages (e.g., Verilog HDL or VHDL) or other suitable programming languages. For example, the related functions of the generator 340, the PWM control circuit 341, the backlight driving circuit 342, the frequency checking circuit 1210, the PWM signal generating circuit 1220, the period defining circuit 610, the first PWM signal generating circuit 620, the second PWM signal generating circuit 630 and/or the superimposing circuit 640 may be implemented in one or more controllers, micro-controllers, microprocessors, application-specific integrated circuits (ASICs), digital signal processors (DSPs), field programmable gate arrays (FPGAs) and/or various logic blocks, modules and circuits in other processing units.

In terms of the software form and/or the firmware form, the related functions of the generator 340, the PWM control circuit 341, the backlight driving circuit 342, the frequency checking circuit 1210, the PWM signal generating circuit 1220, the period defining circuit 610, the first PWM signal generating circuit 620, the second PWM signal generating circuit 630 and/or the superimposing circuit 640 may be implemented as programming codes. For example, the generator 340, the PWM control circuit 341, the backlight driving circuit 342, the frequency checking circuit 1210, the PWM signal generating circuit 1220, the period defining circuit 610, the first PWM signal generating circuit 620, the second PWM signal generating circuit 630 and/or the superimposing circuit 640 may be implemented by using general purpose programming languages (e.g., C, C++or Assembly) or other suitable programming languages. The programming codes may be recorded/stored in recording media. The aforementioned recording media include a read only memory (ROM), a storage device and/or a random access memory (RAM). The programming codes may be accessed from the recording medium and executed by a computer, a central processing unit (CPU), a controller, a micro-controller or a microprocessor to accomplish the related functions. As for the recording medium, a non-transitory computer readable medium, such as a tape, a disk, a card, a semiconductor memory or a programming logic circuit, may be used. In addition, the programs may be provided to the computer (or the CPU) through any transmission medium (e.g., a communication network or radio waves). The communication network is, for example, the Internet, wired communication, wireless communication or other communication media.

Based on the above, in the circuit arrangement and the operation method thereof provided by the embodiments of the invention, a sync period can be at least divided into a first sub-period and a second sub-period. Each of the first waveform pattern in the first sub-period and the second waveform pattern in the second sub-period respectively includes at least one active pulse. The first waveform pattern in the first sub-period is substantially identical to the second waveform pattern in the second sub-period. If the length of the sync period is too long, the first waveform pattern and the second waveform pattern can achieve an effect of frequency multiplication to prevent the human eyes from perceiving the flicker of the backlight source. Thus, the circuit arrangement and the operation method thereof can achieve improving the issue of backlight flicker.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A circuit arrangement for controlling a backlight source, comprising:

a generator, configured to receive a sync signal and generate a pulse width modulation signal synchronous with the sync signal to control the backlight source, wherein the sync signal indicates a frequency of a video comprising a series of image frames, wherein the sync signal comprises a sync period corresponding to an image frame of the video, wherein the generator comprises a pulse width modulation control circuit, configured to generate at least one active pulse during a first sub-period of the sync period including a part or all of a data period of the image frame, and generate at least one active pulse during a second sub-period of the sync period including a part or all of a blanking period of the image frame, at least when a time length of the sync period exceeds a rated time length, wherein the pulse width modulation signal comprises a first waveform pattern in the first sub-period of the sync period and a second waveform pattern in the second sub-period of the sync period, and the first waveform pattern is substantially identical to the second waveform pattern when the time length of the sync period exceeds the rated time length.

2. The circuit arrangement according to claim 1, wherein a duty ratio of the pulse width modulation signal in the first sub-period is equal to a duty ratio of the pulse width modulation signal in the second sub-period.

3. The circuit arrangement according to claim 1, wherein the pulse width modulation control circuit is configured to generate at least one active pulse during the first sub-period of the sync period, and not to generate any active pulse during the second sub-period when the time length of the sync period is shorter than the rated time length.

4. The circuit arrangement according to claim 1, wherein the pulse width modulation control circuit is configured to generate at least one active pulse during the first sub-period of the sync period and to generate any active pulse during the second sub-period when the time length of the sync period is shorter than the rated time length.

5. The circuit arrangement according to claim 4, wherein the pulse width modulation signal comprises a first waveform pattern in the first sub-period of the sync period and a second waveform pattern in the second sub-period of the sync period, and the first waveform pattern is different from the second waveform pattern when the time length of the sync period is shorter than the rated time length.

6. The circuit arrangement according to claim 1, wherein a frequency of the pulse width modulation signal in the first sub-period is equal to a frequency of the pulse width modulation signal in the second sub-period when the time length of the sync period exceeds the rated time length.

7. The circuit arrangement according to claim 1, wherein the pulse width modulation control circuit is further configured to generate a multiplied sync signal according to the sync signal and generate the pulse width modulation signal according to the multiplied sync signal when the frequency of the sync signal is lower than a threshold frequency.

8. The circuit arrangement according to claim 7, wherein the pulse width modulation control circuit serves the sync signal as the multiplied sync signal when the frequency of the sync signal is higher than the threshold frequency, and the pulse width modulation control circuit generates the pulse width modulation signal according to the multiplied sync signal.

9. The circuit arrangement according to claim 1, wherein the pulse width modulation control circuit is further configured to generate the pulse width modulation signal according to another sync signal having a frequency higher than a frequency of the sync signal when the frequency of the sync signal is lower than a threshold frequency.

10. The circuit arrangement according to claim 1, wherein the generator further comprises a backlight driving circuit, coupled to the pulse width modulation control circuit and configured to drive the backlight source of a display panel according to the pulse width modulation signal.

11. The circuit arrangement according to claim 1, wherein the sync signal is received by the pulse width modulation control circuit from a video processing circuit, the video processing circuit comprises a scaler circuit, and the sync signal comprises a vertical sync signal.

12. The circuit arrangement according to claim 1, wherein if a time length of the image frame is changed, a time length of the second sub-period is changed along therewith, and a time length of the first sub-periods is not changed along therewith.

13. The circuit arrangement according to claim 1, wherein an average backlight brightness in different image frames having different time lengths is substantially equal to each another.

14. A circuit arrangement for controlling a backlight source, comprising:

a generator, configured to receive a sync signal and generate a pulse width modulation signal synchronous with the sync signal to control the backlight source, wherein the sync signal indicates a frequency of a video comprising a series of image frames, wherein the sync signal comprises a sync period corresponding to an image frame of the video, wherein the generator comprises:

a pulse width modulation control circuit, configured to generate at least one active pulse during a first sub-period of the sync period and generate at least one active pulse during a second sub-period of the sync period; and a backlight driving circuit, coupled to the pulse width modulation control circuit, and configured to drive the backlight source of a display panel according to the pulse width modulation signal, wherein the backlight driving circuit is configured to drive the backlight source to provide compensation light in the second sub-period, wherein the pulse width modulation control circuit is configured to generate the at least one active pulse during the first sub-period of the sync period, and generate the active pulse during the second sub-period at least when a time length of the sync period is shorter than a rated time length, and wherein the pulse width modulation signal comprises a first waveform pattern in the first sub-period of the sync period and a second waveform pattern in the second sub-period of the sync period, and the first waveform pattern is substantially identical to the second waveform pattern when the time length of the sync period exceeds the rated time length.

15. The circuit arrangement according to claim 14, wherein an average backlight brightness in different image frames having different time lengths is substantially equal to each another.

16. The circuit arrangement according to claim 14, wherein the first sub-period includes a part or all of a data period of the image frame, and the second sub-period includes a part or all of a blanking period of the image frame.

17. The circuit arrangement according to claim 14, wherein a duty ratio of the pulse width modulation signal in the first sub-period is equal to a duty ratio of the pulse width modulation signal in the second sub-period at least when the time length of the sync period exceeds the rated time length.

18. The circuit arrangement according to claim 14, wherein the pulse width modulation control circuit is configured to generate at least one active pulse during the first sub-period of the sync period, and not to generate any active pulse during the second sub-period when the time length of the sync period is shorter than the rated time length.

19. The circuit arrangement according to claim 14, wherein the pulse width modulation control circuit is configured to generate at least one active pulse during the first sub-period of the sync period and to generate any active pulse during the second sub-period when the time length of the sync period is shorter than the rated time length.

20. The circuit arrangement according to claim 19, wherein the pulse width modulation signal comprises a first waveform pattern in the first sub-period of the sync period and a second waveform pattern in the second sub-period of the sync period, and the first waveform pattern is different from the second waveform pattern when the time length of the sync period is shorter than the rated time length.

21. The circuit arrangement according to claim 14, wherein a frequency of the pulse width modulation signal in the first sub-period is equal to a frequency of the pulse width modulation signal in the second sub-period when the time length of the sync period exceeds the rated time length.

22. The circuit arrangement according to claim 14, wherein the pulse width modulation control circuit is further configured to generate a multiplied sync signal according to the sync signal and generate the pulse width modulation signal according to the multiplied sync signal when the frequency of the sync signal is lower than a threshold frequency.

23. The circuit arrangement according to claim 22, wherein the pulse width modulation control circuit serves the sync signal as the multiplied sync signal when the frequency of the sync signal is higher than the threshold frequency, and the pulse width modulation control circuit generates the pulse width modulation signal according to the multiplied sync signal.

24. The circuit arrangement according to claim 14, wherein the pulse width modulation control circuit is further configured to generate the pulse width modulation signal according to another sync signal having a frequency higher than a frequency of the sync signal when the frequency of the sync signal is lower than a threshold frequency.

25. The circuit arrangement according to claim 14, wherein the sync signal is received by the pulse width modulation control circuit from a video processing circuit, the video processing circuit comprises a scaler circuit, and the sync signal comprises a vertical sync signal.

26. The circuit arrangement according to claim 14, wherein if a time length of the image frame is changed, a time length of the second sub-period is changed along therewith, and a time length of the first sub-periods is not changed along therewith.

27. An operation method of a circuit arrangement for controlling a backlight source, comprising:

receiving, by a generator, a sync signal indicating a frequency of a video comprising a series of image frames; and generating, by the generator, a pulse width modulation signal synchronous with the sync signal to control the backlight source, wherein the sync signal comprises a sync period corresponding to an image frame of the video, wherein the generator comprises a pulse width modulation control circuit, the operation method further comprising:

generating, by the pulse width modulation control circuit, at least one active pulse during a first sub-period of the sync period including a part or all of a data period of the image frame at least when a time length of the sync period exceeds a rated time length; and generating, by the pulse width modulation control circuit, at least one active pulse during a second sub-period of the sync period including a part or all of a blanking period of the image frame, at least when the time length of the sync period exceeds the rated time length, wherein the pulse width modulation signal comprises a first waveform pattern in the first sub-period of the sync period and a second waveform pattern in the second sub-period of the sync period, and the first waveform pattern is substantially identical to the second waveform pattern when the time length of the sync period exceeds the rated time length.

28. The operation method according to claim 27, wherein a duty ratio of the pulse width modulation signal in the first sub-period is equal to a duty ratio of the pulse width modulation signal in the second sub-period.

29. The operation method according to claim 27, wherein the operation method further comprising:

generating, by the pulse width modulation control circuit, at least one active pulse during the first sub-period of the sync period, wherein when the time length of the sync period is shorter than the rated time length, the pulse width modulation control circuit do not to generate any active pulse during the second sub-period.

30. The operation method according to claim 27, wherein the operation method further comprising:

generating, by the pulse width modulation control circuit, at least one active pulse during the first sub-period of the sync period; and generating, by the pulse width modulation control circuit, any active pulse during the second sub-period when the time length of the sync period is shorter than the rated time length.

31. The operation method according to claim 30, wherein the pulse width modulation signal comprises a first waveform pattern in the first sub-period of the sync period and a second waveform pattern in the second sub-period of the sync period, and the first waveform pattern is different from the second waveform pattern when the time length of the sync period is shorter than the rated time length.

32. The operation method according to claim 27, wherein a frequency of the pulse width modulation signal in the first sub-period is equal to a frequency of the pulse width modulation signal in the second sub-period when the time length of the sync period exceeds the rated time length.

33. The operation method according to claim 27, wherein the step of generating the pulse width modulation signal comprises:

generating a multiplied sync signal according to the sync signal and generating the pulse width modulation signal according to the multiplied sync signal when the frequency of the sync signal is lower than a threshold frequency.

34. The operation method according to claim 33, wherein the operation method further comprising:

serving the sync signal as the multiplied sync signal when the frequency of the sync signal is higher than the threshold frequency; and generating the pulse width modulation signal according to the multiplied sync signal.

35. The operation method according to claim 27, wherein the operation method further comprising:

generating, by the pulse width modulation control circuit, the pulse width modulation signal according to another sync signal having a frequency higher than a frequency of the sync signal when the frequency of the sync signal is lower than a threshold frequency.

36. The operation method according to claim 27, wherein the operation method further comprising:

driving, by a backlight driving circuit, the backlight source of a display panel according to the pulse width modulation signal.

37. The operation method according to claim 27, wherein the sync signal comprises a vertical sync signal.

38. The operation method according to claim 27, wherein if a time length of the image frame is changed, a time length of the second sub-period is changed along therewith, and a time length of the first sub-periods is not changed along therewith.

39. The operation method according to claim 27, wherein an average backlight brightness in different image frames having different time lengths is substantially equal to each another.

40. An operation method of a circuit arrangement for controlling a backlight source, comprising:

receiving a sync signal and generating a pulse width modulation signal synchronous with the sync signal to control the backlight source by a generator, wherein the sync signal indicates a frequency of a video comprising a series of image frames, wherein the sync signal comprises a sync period corresponding to an image frame of the video, the generator comprises a pulse width modulation control circuit and a backlight driving circuit, the operation method further comprising:

generating at least one active pulse during a first sub-period of the sync period and generate at least one active pulse during a second sub-period of the sync period by the pulse width modulation control circuit;

generating the at least one active pulse during the first sub-period of the sync period by the width modulation control circuit;

generating the active pulse during the second sub-period by the width modulation control circuit at least when a time length of the sync period is shorter than a rated time length, wherein the pulse width modulation signal comprises a first waveform pattern in the first sub-period of the sync period and a second waveform pattern in the second sub-period of the sync period, and the first waveform pattern is substantially identical to the second waveform pattern when the time length of the sync period exceeds the rated time length; and driving the backlight source of a display panel according to the pulse width modulation signal by the backlight driving circuit, wherein the backlight source providing compensation light in the second sub-period is driven by the backlight driving circuit.

41. The operation method according to claim 40, wherein an average backlight brightness in different image frames having different time lengths is substantially equal to each another.

42. The operation method according to claim 40, wherein the first sub-period includes a part or all of a data period of the image frame, and the second sub-period includes a part or all of a blanking period of the image frame.

43. The operation method according to claim 40, wherein a duty ratio of the pulse width modulation signal in the first sub-period is equal to a duty ratio of the pulse width modulation signal in the second sub-period at least when the time length of the sync period exceeds the rated time length.

44. The operation method according to claim 40, wherein the operation method further comprising:

generating at least one active pulse during the first sub-period of the sync period the pulse width modulation control circuit, wherein the pulse width modulation control circuit do not to generate any active pulse during the second sub-period when the time length of the sync period is shorter than the rated time length.

45. The operation method according to claim 40, wherein the operation method further comprising:

generating at least one active pulse during the first sub-period of the sync period by the pulse width modulation control circuit; and generating any active pulse during the second sub-period by the pulse width modulation control circuit when the time length of the sync period is shorter than the rated time length.

46. The operation method according to claim 45, wherein the pulse width modulation signal comprises a first waveform pattern in the first sub-period of the sync period and a second waveform pattern in the second sub-period of the sync period, and the first waveform pattern is different from the second waveform pattern when the time length of the sync period is shorter than the rated time length.

47. The operation method according to claim 40, wherein a frequency of the pulse width modulation signal in the first sub-period is equal to a frequency of the pulse width modulation signal in the second sub-period when the time length of the sync period exceeds the rated time length.

48. The operation method according to claim 40, wherein the operation method further comprising:

generating a multiplied sync signal according to the sync signal and generating the pulse width modulation signal according to the multiplied sync signal by the pulse width modulation control circuit when the frequency of the sync signal is lower than a threshold frequency.

49. The operation method according to claim 48, wherein the operation method further comprising:

serving the sync signal as the multiplied sync signal by the pulse width modulation control circuit when the frequency of the sync signal is higher than the threshold frequency; and generating the pulse width modulation signal according to the multiplied sync signal by the pulse width modulation control circuit.

50. The operation method according to claim 40, wherein the operation method further comprising:

generating the pulse width modulation signal according to another sync signal having a frequency higher than a frequency of the sync signal by the pulse width modulation control circuit when the frequency of the sync signal is lower than a threshold frequency.

51. The operation method according to claim 40, wherein the sync signal is received by the pulse width modulation control circuit from a video processing circuit, the video processing circuit comprises a scaler circuit, and the sync signal comprises a vertical sync signal.

52. The operation method according to claim 40, wherein if a time length of the image frame is changed, a time length of the second sub-period is changed along therewith, and a time length of the first sub-periods is not changed along therewith.

* * * * *